US005423197A

United States Patent [19]

Roser

[11] Patent Number: 5,423,197

[45] Date of Patent: Jun. 13, 1995

[54] YARN-DELIVERY DEVICE FOR YARN-CONSUMING TEXTILE MACHINES

[76] Inventor: Erich Roser, Pirolweg 5, 88699 Altheim, Germany

[21] Appl. No.: 204,419

[22] PCT Filed: Sep. 3, 1992

[86] PCT No.: PCT/DE92/00751

§ 371 Date: Mar. 15, 1994

§ 102(e) Date: Mar. 15, 1994

[87] PCT Pub. No.: WO93/06283

PCT Pub. Date: Apr. 1, 1993

[30] Foreign Application Priority Data

Sep. 26, 1991 [DE] Germany ..... 41 32 003.4
Mar. 3, 1992 [DE] Germany ..... 42 06 607.7

[51] Int. Cl.[6] ..... B65H 51/22; D04B 15/48

[52] U.S. Cl. ..... 66/132 R; 66/125 R; 242/47.01; 242/47.06

[58] Field of Search ..... 242/47.01, 47.05; 66/125 R, 132 R

[56] References Cited

U.S. PATENT DOCUMENTS 2,289,390 7/1942 Torrence et al. ..... 242/47.05
3,700,153 10/1972 Delair et al. ..... 66/132 R X
4,504,022 3/1985 Stang et al. ..... 242/47.01
4,673,139 6/1987 Memminger et al. ..... 66/132 R X
4,692,178 9/1987 Smith, Jr. et al. ..... 65/2
4,706,476 11/1987 Memminger et al. ..... 66/132 R
5,050,405 9/1991 Jacobsson ..... 242/47.01 X

FOREIGN PATENT DOCUMENTS

0256519A1 2/1988 European Pat. Off. .
1785501 10/1970 Germany .
2156355 5/1972 Germany .
239619A5 10/1986 Germany .
3820618C2 12/1989 Germany .
3832381C1 12/1989 Germany .

*Primary Examiner*—John J. Calvert
*Attorney, Agent, or Firm*—Spencer, Frank & Schneider

[57] ABSTRACT

A yarn-delivery device serving as a yarn feeder for textile machines is proposed. To provide an optimum regulation of the yarn transport even for more than one yarn, the yarn-delivery device has a storage drum which is made in one piece with the rotor or armature of the drive motor and which has on its circumference a wire lattice formed by wires arranged in an X-shaped manner. To regulate the yarn tension from the consumer, there is a yarn-tension sensor, the mechanical deflection of which causes an electronic adjustment of the drive motor.

19 Claims, 4 Drawing Sheets

YARN-DELIVERY DEVICE FOR YARN-CONSUMING TEXTILE MACHINES

BACKGROUND OF THE INVENTION

The invention relates to a yarn-delivery device as a yarn feeder for textile machines including a bobbin for a yarn, a storage drum, and a drive motor having a rotor. The motor draws the yarn off from the bobbin. A yarn-tension sensor is provided that is mechanically deflected by the yarn running off the storage drum. Further, means for electronically evaluating and converting the mechanical deflection of the yarn-tension sensor are provided for regulating a drive of the drive motor.

STATE OF THE ART

Yarn-delivery devices, also called storage feed-wheels, as yarn feeders for textile machines are already known, having a storage drum which is fastened to the shaft end of an electric motor and on the circumference of which a plurality of turns of the yarn to be conveyed lie in a slip-free manner (German Offenlegungsschrift P 34 29 207.1-26). The rotational speed of the storage drum is transmitted directly to the electric motor of the storage drum via control electronics by suitable pulse transmitters on the circular knitting machine. A so-called autosyn is thereby obtained between the machine and yarn-delivery device. Further sensors which sense the yarn readjust the set desired value.

Furthermore, a yarn-delivery device, the storage drum of which is likewise attached to the shaft end of an electric motor, has become known (German Offenlegungsschrift P 38 30 381 C1; P 38 20 618 A1). However, here, the signal transmission to the motor takes place via a sensor lever on the yarn which is held magnetically in a variable position. The adjustable return force on the lever then corresponds to the variable desired value for the yarn tension required.

In textile machines, a specific yarn quantity of the appropriate desired value becomes necessary immediately when the knitting machine is switched on directly. The commercially conventional motors required for this and having an appropriately sufficient starting torque and the necessary run-up time are of a constructional size such that they cannot be installed in the housing sizes currently used. In known devices, therefore, there has been a sensor lever which provides a variable yarn reserve between the storage drum and yarn consumer. During the reduction of this reserve, the motor can then be brought to the necessary rotational speed which corresponds to the desired delivery quantity. This yarn reserve is obtained by a multiple deflection of the yarn, for example by means of eyes. However, extreme frictional losses and especially the formation of fluff occur as a result. Furthermore, elastomeric yarns can hardly be regulated in this way or, at most, only very slow rotational speeds are possible.

For a satisfactory lap formation on the storage drum, the known yarn-delivery devices have a preceding permanently set or variable yarn brake. For this, either the yarn is guided through an eye which is weighted, for example by means of a ball, or it is drawn through a disc brake. Here too, depending on the material used, annoying quantities of fluff are obtained. Under high braking forces, the yarn turns on the storage drum will naturally lie on it firmly and be drawn together, most types of yarn being stretched. The yarn then relaxes at the measuring point, for example at a sensor lever, and the sensor lever itself can be set in vibration. The lever must therefore in turn be steadied mechanically.

The known devices therefore altogether still have some weak points which have to be considered as an unsatisfactory overall solution involving too high a technical outlay.

SUMMARY OF THE INVENTION

The object on which the invention is based is to provide a yarn-delivery device, in which the individual subassemblies can be coordinated with one another as exactly as possible, thereby providing an optimum overall system. The object of the invention is, furthermore, also to improve or optimise individual subassemblies of the yarn-delivery device for particular special uses.

This object is achieved by connecting the storage drum to the rotor to form a single unit. The storage drum stores the yarn drawn off from the bobbin in a plurality of turns lying next to one another. The storage drum includes a plurality of steel wires arranged in an X-shaped pattern and forming a wire lattice at a circumference of the storage drum so that the yarn can be fed to and removed from the storage drum.

ADVANTAGES OF THE INVENTION

The advantage of the yarn-delivery device according to the invention in relation to the known devices is that all the constructional elements of the device have been optimised and coordinated with one another.

So that the known devices driven by belts and having their predetermined housing size can be replaced directly, a completely new and electronically driven direct-current motor having a series of advantages in relation to known stepping motors has first been provided. These advantages must initially be seen in the very simple construction of the motor with a very low movable motor mass, along with an at least equal or better acceleration capacity. By virtue of its design, the EC motor allows a drive free of catching force in the currentless state, so that a simple mechanical threading of the yarn is possible. Because a low-mass rotor or armature serving as a magnet carrier for permanent magnets is used, a very small constructional size with a small axial length can be achieved. At the same time, the motor works with quiet running and high efficiency and therefore low heating. The thereby possible arrangement of the associated electronic board in the vicinity of the motor also allows a highly compact construction of the device as a whole. The high-quality permanent magnets in the rotor, which interact with a corresponding number of coil groups in the stator, are responsible for the high efficiency.

An essential advantage of the invention is the combination of the motor according to the invention with the storage drum connected in one piece to it. The armature or rotor of the direct-current motor serves as a base for the storage drum, thereby providing, apart from the mass of the high-performance magnets, a system which is extremely light and consequently easy to accelerate. For this, the system is formed from a light plastic disc which functions as a magnet carrier and armature and to which the X-shaped steel wires are attached in one piece and connected to an outer ring. The X-shaped steel wires on the circumference of the storage drum form a run-on slope for the yarn, whilst two yarns can simultaneously be stored and therefore delivered.

A further advantage of the invention is the control of the yarn tension after the storage drum, which is brought about by a special helical spring which is of trumpet-shaped cross-section or is designed as a cone of revolution. The deflection of the helical spring is related directly to the yarnpull and consequently to the yarn quantity required. By an electronic evaluation of the deflection of the helical spring, a direct and delay-free control of the storage-drum drive motor is obtained.

Especially advantageous, furthermore, is a yarn brake which is provided in front of the storage drum and likewise works with the least possible bearing-friction resistances and which can be adjusted and/or regulated by means of a magnetic field provided laterally. The run of the yarn to the storage drum can thereby be regulated and adapted.

The yarn brake, storage drum and helical spring are so coordinated with one another in regulating terms that an optimum yarn feed is guaranteed for the textile machine.

BRIEF DESCRIPTION OF THE DRAWINGS

Further particulars essential to the invention and advantages are illustrated in the drawing and are explained in more detail in the following description.

In the drawing

DESCRIPTION OF THE PREFERRED EMBODIMENT

Figure 2:
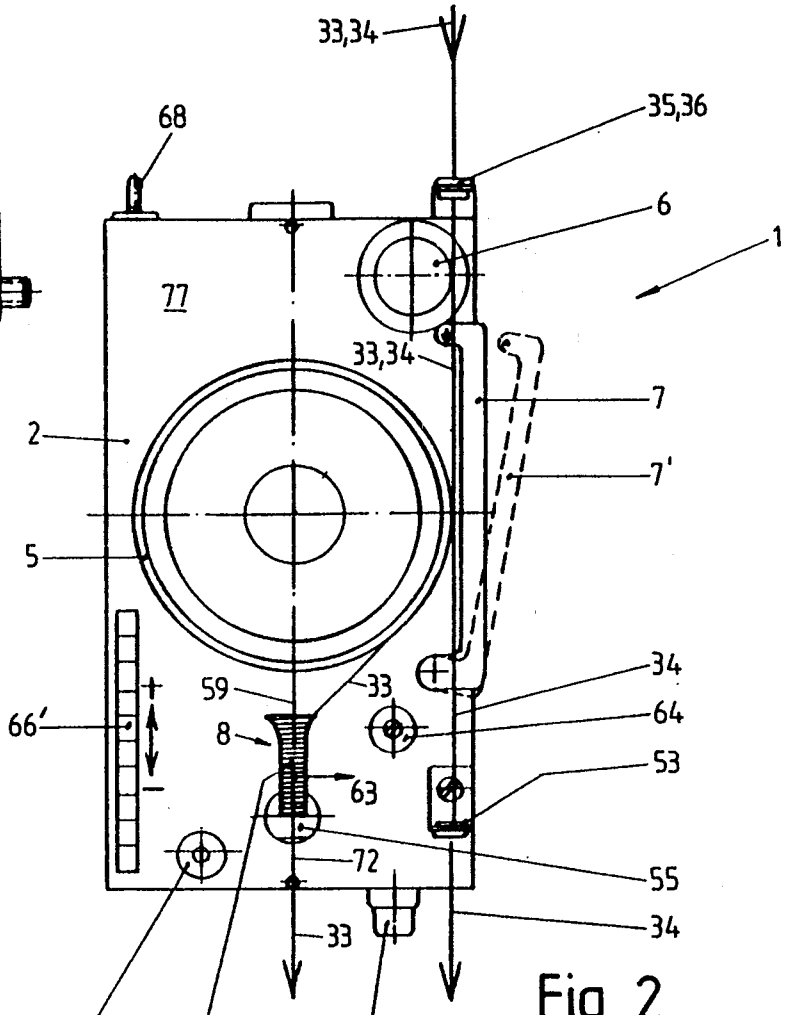
FIG. 2 shows a front view of the yarn-delivery device.
Figure 1:
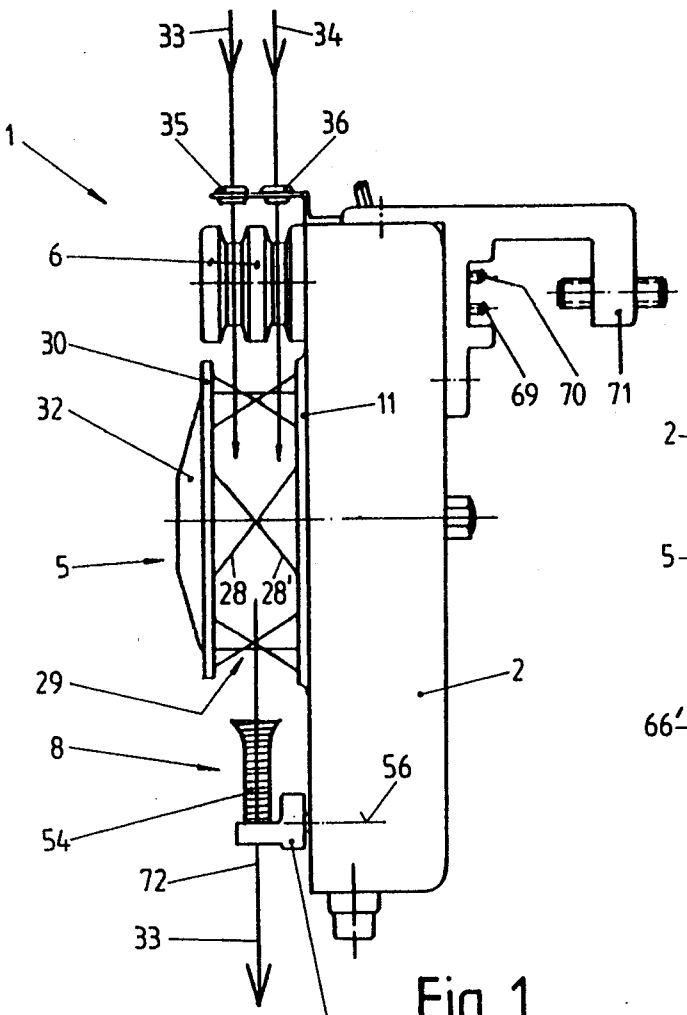
FIG. 1 shows a side view of the yarn-delivery device.
Figure 3:
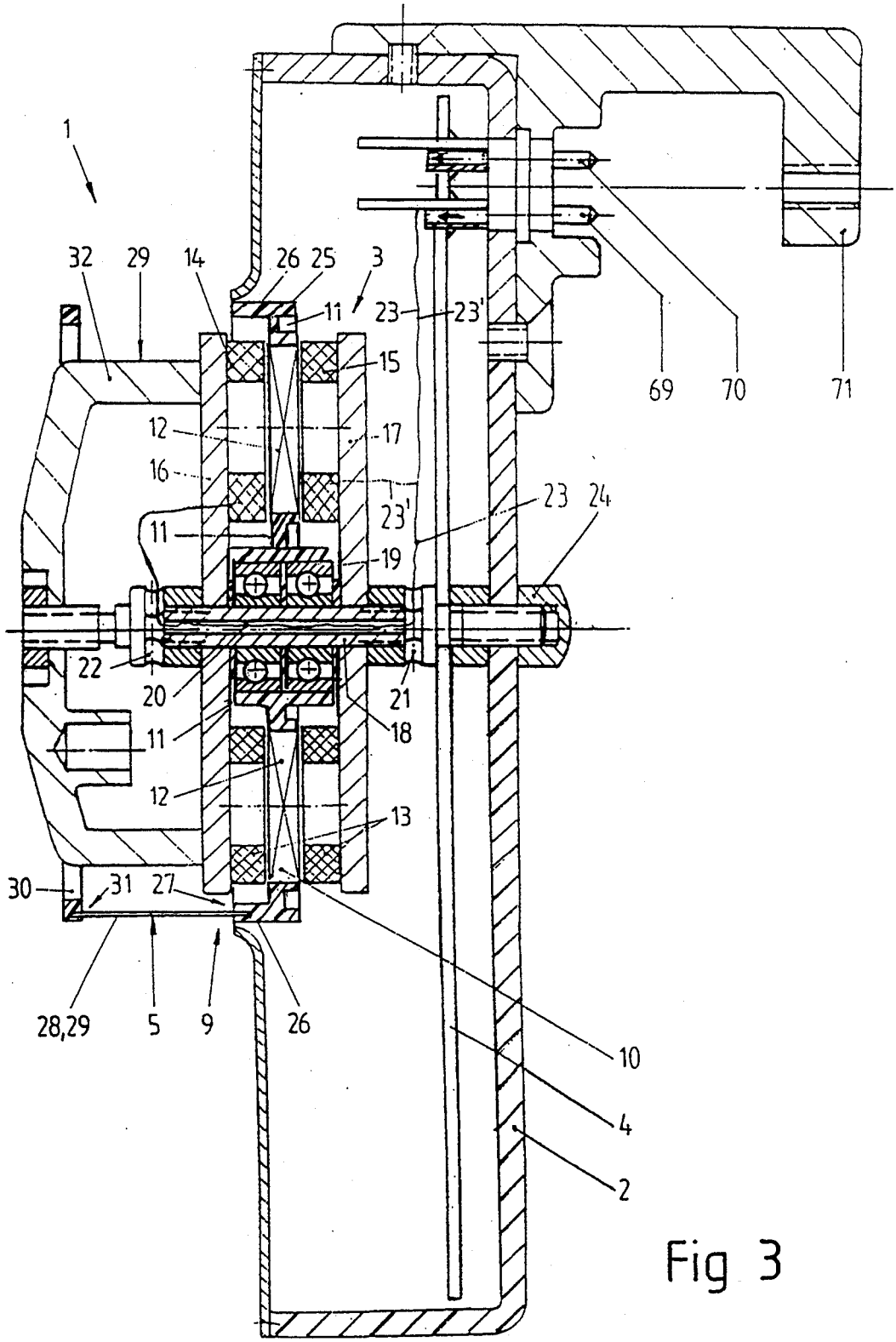
FIG. 3 shows a longitudinal section of the yarn-delivery device, especially through the direct-current motor.

The yarn-delivery device 1 illustrated in FIGS. 1 to 3 consists of a housing 2 for receiving a drive motor 3 and of a board 4 for the control electronics. The drive motor 3 forms a constructional unit with the storage drum 5, as shown in more detail in FIGS. 4*a, b*.

The yarn-delivery device 1 possesses, furthermore, a yarn brake 6 and a yarn-break sensor 7 as constructional units preceding the storage drum 5, as well as a yarn-tension sensor 8 which follows the storage drum 5 for the purpose of controlling the yarn tension. A more detailed representation of this system is reproduced in FIGS. 5*a* and 5*b*. The individual constructional elements of the yarn-delivery device according to the invention are explained in more detail as follows:

In FIG. 3, the drive unit 9 of the yarn-delivery device 1, consisting of the drive motor 3 and storage drum 5, is shown in more detail.

The drive motor 3 is designed as an electronically commutated direct-current motor of the four-pole type. In view of the disc-rotor construction, it has a small axial length. The direct-current motor 3 consists of a rotor or armature 10 which is designed as a plastic disc and which serves as a magnet carrier. For this purpose, four round or otherwise shaped permanent magnets 12 are embedded in the plastic disc 11.

The stator 13 of the direct-current motor consists of two coil groups 14, 15 with short-circuit plates 16, 17 arranged behind them and slipped on a hollow shaft 18. The rotor 10 is mounted on the hollow shaft 18 via two ball bearings 19 as compensation for the alternating tilting moment caused by the magnetic field. The hollow shaft 18, having a longitudinal bore 20 and two transverse bores 21, 22 at its respective ends, serves for receiving the switching junction wires 23 between the coil group 14 and the control board 4. The coil group 15 is connected to the control board 4 via a corresponding switching junction wire 23'. This hollow shaft 18 receives, furthermore, a switching junction wire which actuates the luminous yarn-break indicator.

The coil groups 14, 15 are completely identical in their construction and can therefore be produced with the same tools.

The hollow shaft 18 passes through the board 4 for the control electronics and is fastened to the rear side of the housing by means of a nut 24.

Figure 4B:
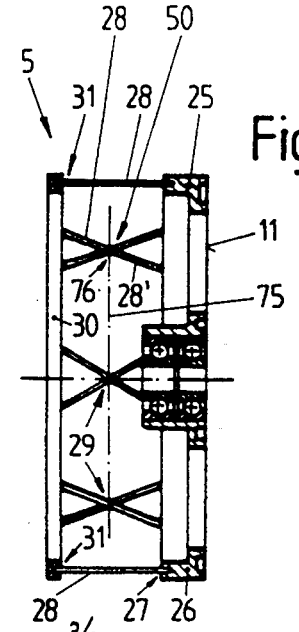
FIGS. 4*a*, 4*b* show a more detailed representation of the storage drum.

The rotor 10 designed as a plastic disc 11 with magnets 12 is designed so that it also serves at the same time as a constructional part of the storage drum 5, also called a yarn wheel. For this, the outer rim 25 of the plastic disc 11 has a continuous shoulder 26 with the bores 27, in which are embedded the individual wires 28, 28' of a yarn-feed cross which form continuously a wire lattice 29 (see also FIG. 4*a*, 4*b*). The wire lattice 29 is limited on the side located opposite the plastic disc 11 by an outer plastic ring 30 which likewise has bores 31 for receiving the individual wires 28, 28'.

On the outside diameter or the thereby formed cylindrical surface of the plastic ring 30 or of the plastic disc 11 are located, for example, five to eight yarn-feed crosses in an X-shaped arrangement, consisting of the inserted polished steel wires 28, 28', which together form the wire lattice 29 arranged on the outer cylindrical surface of the storage drum 5. The angle $\alpha$ formed in the axial direction of the drive motor between two associated wires 28, 28' is approximately $\alpha \approx 60°$ to $110°$ (see FIG. 4*a*).

The electronically controlled direct-current motor 3 works free of catching force in the currentless state, so that a simple manual threading of the yarns is possible. Extremely short run-up times of the motor are obtained as a result of a low-mass design of all the rotating parts of the rotor 10 and of the storage drum 5 and by the use of high-quality permanent magnets 12. At the same time, the motor is controlled in terms of reaction force, in order to regulate the yarn tension. The high efficiency of the direct-current motor ensures low heating. The electronic board 4 can consequently be arranged in the immediate vicinity of the motor, thereby affording a highly compact construction of the device as a whole.

As is evident from FIGS. 1 and 3, the storage drum 5 is equipped on its front side with an additionally flashing luminous indicator 32 for indicating a yarn break.

Figure 6:
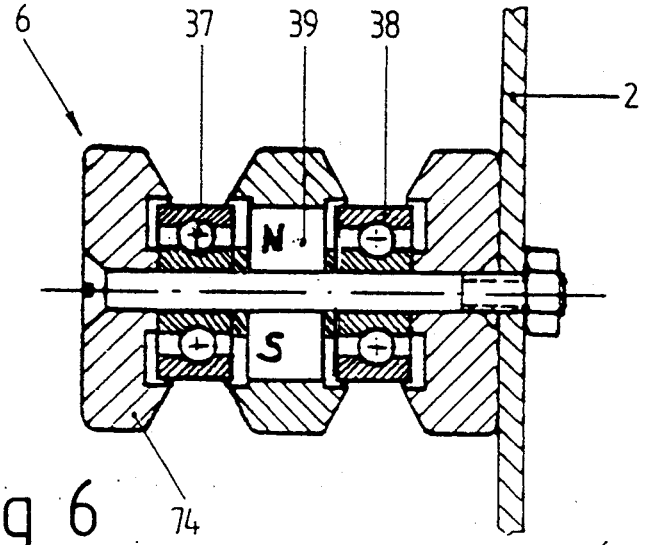
FIG. 6 shows a section through the yarn brake.

Furthermore, the device front side, illustrated in FIG. 2, and the associated side view in FIG. 1 show, for the feed of two yarns 33, 34, respective run-in eyes 35, 36 for feeding the yarns to a double yarn brake 6. This double yarn brake 6 shown in more detail in FIG. 6 consists of two closed ball bearings 37, 38 which are arranged next to one another in a ball-bearing housing 74 and onto the outer cylindrical surface of which the respective yarns 33, 34 are applied with at least one turn. The run-in direction of the yarn is thereby preserved. Located in the ball-bearing housing between the ball bearings 37, 38 is a permanent magnet 39 of an axial magnetisation in the form of two sectors, that is to say an upper north pole and a lower south pole. During each rotation of the respective bearing, the bearing balls of the ball bearing are on the one hand attracted (for example north pole) and in the next sector (south pole) are repelled, with the result that a braking effect in the form of bearing friction occurs.

Specific run-in resistances exist between the yarn brake 6 and the yarn bobbin. When the feed resistance relative to the bobbin is low, the outer ring of the respective ball bearing 37, 38 does not corotate. The loop laid round the ball bearing then slips on the outside diameter of the cylindrical surface of the ball bearing and generates only a slight braking effect. When the run-in resistances between the bobbin and the storage drum increase as a result of sporadic resistances, caused by knots or accumulations of fluff, the yarn loop round the outer ring of the ball bearing is tightened, with the result that a take-up of the outer ring of the respective ball bearing 37, 38 occurs. These alternating effects of the sporadic resistance give rise to an almost horizontal braking characteristic, resulting in an extremely uniform yarn transport.

If the permanent magnet 39 is replaced by a live electromagnetic coil, the braking force can be regulated continuously within wide limits. The yarn brake 6 can be equipped with one ball bearing for delivering one yarn or with a double ball bearing for delivering two yarns. In so far as two bearings are provided, both exert a braking effect independently of one another.

The yarn brake 6 is followed by a yarn-break sensor 7. This arrangement is shown in more detail in FIG. 2 and in FIG. 7.

A mounting 40 made in the housing 2 serves for mounting a lever 41. At the upper end of the lever 41 is located a pin 42 which is perpendicular to the lever 41 and which is held in its setting or position by the yarn 33, 34 running through. If a yarn break occurs, the lever 41 falls as a result of gravity into the position of the yam-break sensor 7' shown in FIG. 2 and represented by broken lines. At the lower end of the lever 41, a shaft 43 leads through the bearing 40. At the lower end of the shaft 43 is located a permanent magnet 44 which is so mounted that a reed relay 45 is cut in or cut out by the pivoting movement of the lever shaft 43. The reed relay actuates the luminous yarn-break indicator 32 simultaneously with the cut-off of the circular hitting machine. The lever 41 exerts only a slight frictional effect on the yarn 33, 34 via the pin 42. It can equally or alternatively be installed between the storage drum 5 and the yarn-tension sensor 8, in order to monitor a yarn break there in the same way.

In the event of a non-vertical mounting of the device, for example a horizontal arrangement, when a yarn break occurs the deflection of the lever 7 must be brought about using an additional spring. The device can consequently be operated in any position.

In a circular knitting machine, the device is directed with its front side or tending side 77 preferably radially outwards, in order to allow simple attendance at the front.

Figure 7:
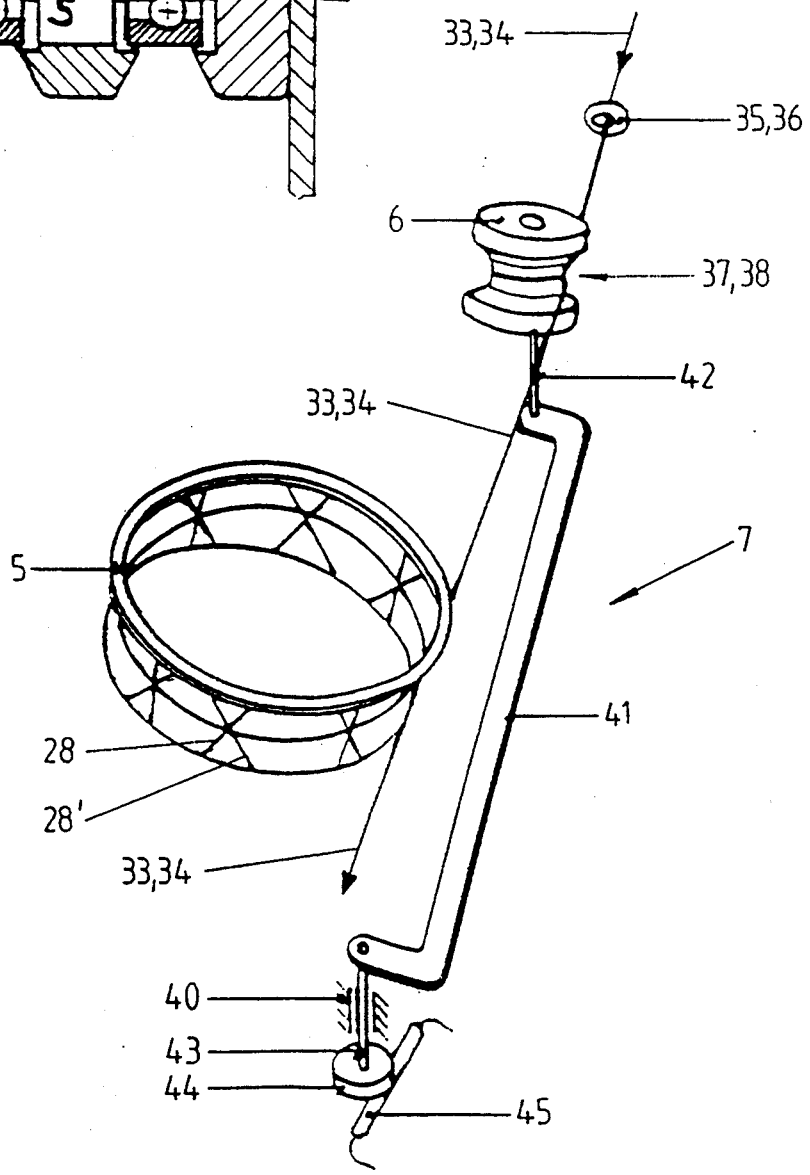
FIG. 7 shows a diagrammatic representation of the yarn-break sensor.

The yarn 33, 34 guided via the yarn brake 6 and via the yarn-break sensor 7 is fed to the storage drum 5 according to the representation in FIGS. 1, 2 and 7. For this, the storage drum 5 and the rotor 10 of the drive motor 3 form a constructional unit, extremely light materials being used, so that a very low mass has to be accelerated. The run-up time of the motor is so short that yarns can be fed directly to the running machine up to approximately 10 m per second. The timed commutator free electronic control for the rotor 10 ensures a very low current consumption which is of a value up to three times below the current consumption of known devices. Even in the event of an overload, the current consumption is maintained automatically at a set maximum value, so that, even during a lengthy stoppage under load, no damage to the rotor or armature or to the windings can occur.

The polished steel wires 28, 28' inserted in the form of an X and intended for forming the wire lattice 29 provided on the cylindrical surface of the storage drum 5 ensure an automatic yarn feed on the storage drum 5. In this construction according to the invention, there is no need for special run-on slopes of known devices, since this occurs as a result of the X-shaped arrangement of the wires 28, 28' themselves. A specific run-on point for the yarn on the storage drum 5 is also unnecessary. As shown in more detail in FIG. 1 in conjunction with FIG. 4*a*, the yarns 33, 34 can be fed on the left-hand half 46 and on the right-hand half 47 of the width b of the wire lattice 29. If the total width b of the wire lattice 29 is divided into six parts ($2\times3/3$), each yarn can be fed without difficulty in the two outer regions 48, 49 which have a width $a=b/3$. The run-on point of the particular yarn 33, 34 onto the storage drum 5 can therefore be selected freely according to the desired lap length, since the outer run-on region 48, 49 allows a plurality of turns. At the same time, two yarns for two different knitting systems with the same yarn consumption can be stored and delivered simultaneously.

Figure 4A:
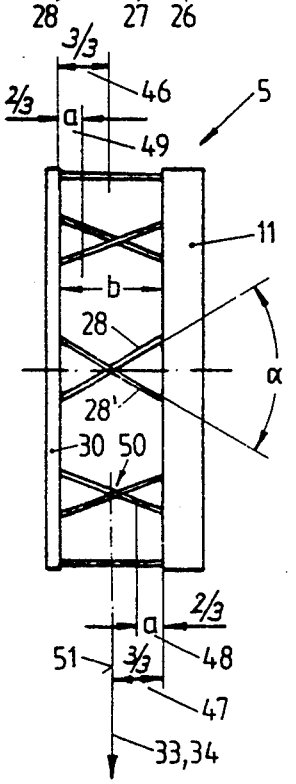
Figure 5A:
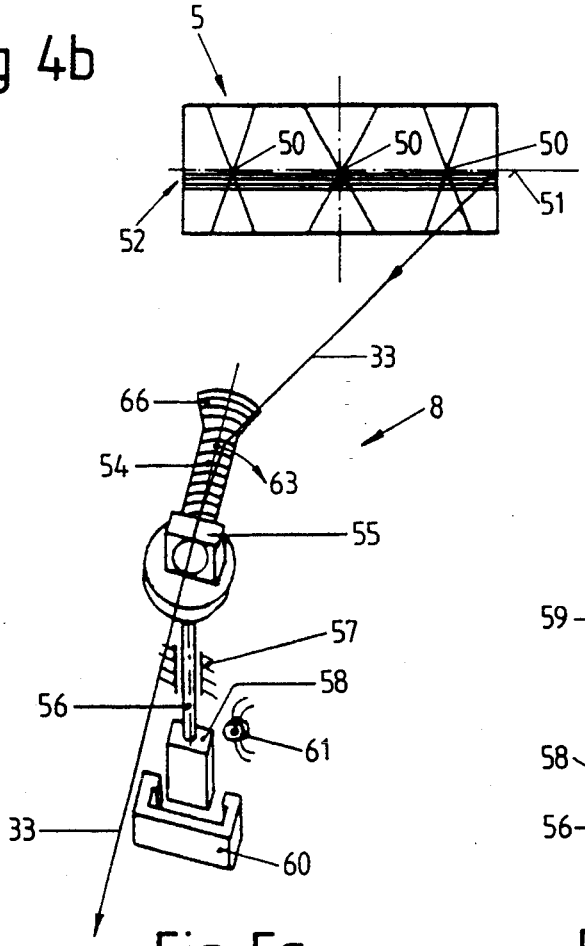
FIGS. 5*a*, 5*b* show the helical spring for controlling the yarn tension.

As a result of the X-shaped arrangement of two respective wires 28, 28' of the wire lattice 29 which are arranged relative to one another, each fed yarn basically runs on the slope of the X-shape to the central intersection point 50 of the respective wires (centre line 51). The yarn run-on is therefore entirely non-critical, since the individual turns are respectively lined up in a row next to one another. The wound yarn plies consequently line up to the left and to the right from the centre line 51 connecting the intersection points 50 to one another. FIG. 5*a* shows by way of example a storage drum 5, in which four yarn plies 52 lying next to one another are wound on the lower half of the storage drum 5. Each individual or both running-on yarns run off basically from the centre line 51, as shown in FIG. 4*a*. At the same time, the two running-out yarns lie next to one another so as to touch at the X-shaped intersection point. Since the diameter of the storage drum 5 for the two yarns is of equal size at this location, the two yarn lengths are also identical. A thin separating disc 75 (shown schematically in FIG. 4*b*) can also be attached on the centre line 51 for the purpose of separating the two running-off yarns. There is no need to fasten the disc, because the disc can be provided with transverse holes 76, through which the intersection point 50 of the wires 28, 28' extends.

As is evident from FIGS. 1, 2 and 5*a*, the storage drum 5 is followed by a yarn-tension sensor 8 which serves for controlling the yarn tension. Since the two yarns 33, 34 drawn off from the storage drum 5 are basically drawn off from the same outside diameter of the storage drum 5, namely from the centre line 51 (X-inter-section point 50), it is generally sufficient if only one yarn 33 is monitored via the yarn-tension sensor 8, whilst the other yarn 34 is guided from the storage drum 5 directly through an eye 53 (see FIG. 2).

The twofold occupancy of the yarn-delivery device with yarns 33, 34 in relation to conventional devices with only one yarn has considerable economic significance.

If the yarn tension is varied automatically or manually during the knitting operation, the non-monitored yarn also experiences the same variation in a similar way to a twin.

As a result of the special arrangement of the X-shaped wires 28, 28', with some types of yarn it is possible, if appropriate, to omit the yarn brake 6, for the yarn resistance itself is already usually sufficient to allow a braked winding of the yarn onto the storage drum 5. The yarn resistance occurs, for example, as a result of the unwinding operation from the bobbin and the deflections associated with this.

It must also be stressed, in this respect, that even bare rubber yarns can be processed in an outstanding way as a result of the arrangement according to the invention. Here too, where appropriate, a yarn brake 6 has proved to be not absolutely necessary, that is to say the yarn can be guided past the brake 6 without contact. Fine copper-lacquered wires can also be stored on the storage drum 5 without further action and dispensed with the desired wire tension, the insulating lacquer not being damaged.

Figure 5B:
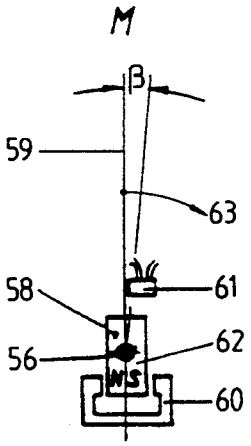

The yarn-tension control, shown in FIGS. 1, 2 and 5*a* and 5*b*, by a yarn-tension sensor 8 takes place preferably by a helical spring 54 which is wound in a trumpet-shaped manner and which is fastened to a rotatable head 55. The rotatable head 55 has a shaft 56 which is guided in a bearing 57 into the interior of the housing 2. A permanent magnet 58 is fastened centrically or eccentrically to the lower shaft end of the shaft 56 in such a way that the permanent magnet 58 lies with the north/south separating line on the mid-axis 59 of the device (see FIG. 2 and FIG. 5*b*). An iron yoke 60 of a Hall sensor 61 on the opposite side keeps the magnet 58 in the middle position M as shown in FIG. 5*b*. The separating line 62 between the north and south poles of the permanent magnet 58 is located on the mid-axis 59. The Hall sensor 61 is placed in such a way that, in the event of a small angular deviation $\beta$ from this middle position M, it activates the motor control. An only slight increase in the yarn tension of the yarn 33 causes a deflection of the helical spring 54 arranged on the centre line 59 in the direction of the arrow 63 shown in FIGS. 2 and 5*a*, 5*b*. This angular deviation $\beta$ regulates the motor speed between a zero value and full speed, the angular deviation being so small and brief that the movement can be perceived visually only with difficulty. Very short run-up times can be achieved as a result of the special motor construction. There is therefore no longer any need for a separate yarn-storage device. The adjustment of the yarn tension can be carried out manually on the potentiometer 64 (see FIG. 2) or computer-controlled via the computer connection 65. By adjusting the offset zero voltage on the Hall sensor, the desired position of the north/south transition of the permanent magnet 58 can be displaced, with the result that the yarn tension can be adjusted by means of $V_{ref}$ or by computer control.

The advantage of designing the yarn-tension sensor 8 with a wound trumpet-shaped helical spring 54 is that vibrations which can arise as a result of the polygonal yarn lie on the circumference of the storage drum 5 are absorbed, thereby ensuring a smooth yarn runoff. The trumpet-shaped helical spring 54 with the upper trumpet-shaped mouth 66 for the tangential introduction of the yarn 33 therefore also constitutes a damping member in the arrangement of the yarn-tension sensor 8.

In FIG. 2, reference numeral 66' denotes an optical desired-value indicator, and reference numeral 67 shows an optical operational indicator of the device. Reference numeral 68 shows a device on-off switch.

Furthermore, FIGS. 1 and 3 show standard pins 69, 70 which, together with the earth terminal 71, guarantee the necessary current supply. At the same time, the terminal 69, 71 serves for supplying the device with the necessary known voltage of 24 Volts. The pin 70 serves as a conductor for stopping the machine in the event of a yarn break.

The special embodiment of the yarn-delivery device according to the invention allows a direct exchange with known belt-driven devices. At the same time, the knitting machine also experiences an appreciable simplification in its construction and outlay. Of course, the devices according to the invention can also be operated in any position, in so far as the yarn break sensor 7 is supported not by its own weight, but, for example, by means of a spring, and can fall off in the event of a yarn break. The yarn run can also be guided by eyes 35, 36, without deflection, by way of the yarn brake 6 to the yarn-tension sensor 8. The trumpet shape of the helical spring 54 allows a smooth deflection of the yarn into the spring and smooth guidance within the spring as far as its lower exit 72. The result is that fluff formation scarcely occurs at all throughout the entire yarn run.

It has been possible to reduce the weight of the device to half that of belt-driven devices. The commutator-free drive motor 3 automatically ensures a lifetime which depends on the lifetime of the ball bearings used. The devices are therefore virtually maintenance-free.

There is no need to use additional lamps for the purpose of indicating the yarn break. A long-life flasher system by means of the luminous yarn-break indicator 32 allows a lifetime of approximately 5 to 10 years.

If a conventional knitting machine has required two or more different yarn quantities, this has been achieved by means of a plurality of drive belts in a plurality of planes. The mechanical outlay is correspondingly high. In contrast to this, devices according to the invention adapt automatically to the desired yarn quantity, a regulation of the set yarn tension simultaneously taking place. At the same time, the drive motor is designed so that it has no catching moments. The yarns can therefore be drawn over the storage drum 5 almost without any resistance.

The invention is not restricted to the exemplary embodiment described and illustrated. On the contrary, it also embraces all developments and modifications available to an average person skilled in the art within the scope of the inventive idea.

I claim:

1. A yarn-delivery device for textile machines, comprising:

a bobbin for a yarn;

a drive motor having a rotor, said motor drawing the yarn off from said bobbin;

a storage drum connected to said rotor to form a single unit, said storage drum storing the yarn drawn off from said bobbin in a plurality of turns lying next to one another, said storage drum including a plurality of steel wires arranged in an X-shaped pattern and forming a wire lattice at a circumference of said storage drum so that the yarn can be fed to and removed from said storage drum;

a yarn-tension sensor being mechanically deflected by the yarn running off said storage drum; and regulating means for electronically evaluating and converting the mechanical deflection of said yarn-tension sensor for regulating a drive of said drive motor.

2. Yarn-delivery device according to claim 1, wherein the drive motor is a commutator-free, electronically commutated direct-current motor, the rotor is a disc rotor with high-performance permanent magnets, and wherein the drive motor has a stator comprising two mutually opposite identical coil groups with short-circuit plates.

3. Yarn-delivery device according to claim 1, wherein the rotor is a plastic disc carriably receiving four permanent magnets.

4. Yarn-delivery device according to claim 1, wherein in a currentless state, the drive motor is free of a catching force and is regulated by a reaction force to regulate a yarn tension.

5. Yarn-delivery device according to claim 2, wherein the rotor includes a hollow shaft having two opposing ends and transverse bores provided at the ends for feeding switching junction wires to the coil groups and to a luminous yarn-break indicator.

6. Yarn-delivery device according to claim 1, wherein two yarns are feedable onto the storage drum each at a location remote from intersection point of the X-shape of the individual wires, each yarn being slidable inwards towards the intersection point.

7. Yarn-delivery device according to claim 1, wherein the rotor comprises a plastic disc formed together with the storage drum to form the single unit made of an extremely light material, the storage drum including an outer plastic ring, the plastic disc comprising an inner disc having an outer circumference and an outer rim on the outer circumference, the outer rim having attachment bores for the steel wires, the steel wires being connected to the outer plastic ring.

8. Yarn-delivery device according to claim 7, wherein the wire lattice includes approximately 4 to 8 yarn-feed crosses arranged in the X-shaped pattern and which are inserted tangentially into an imaginary cylindrical surface formed between an outer edge of the plastic disc and the outer plastic ring.

9. Yarn-delivery device according to claim 1, wherein the yarn-tension sensor and the regulating means control a yarn tension after the storage drum by regulating a motor speed of the drive motor, the yarn tension being measurable electronically from a consumer.

10. Yarn-delivery device according to claim 8, wherein the yarn-tension sensor controls a yarn tension and includes a helical spring having a trumpet-shaped cross-section, the yarn being guided through and damped by the helical spring.

11. Yarn-delivery device according to claim 9, wherein the yarn-tension sensor includes a helical spring having a trumpet-shaped portion in an upper region of the spring for receiving the yarn, the helical spring being connected in a lower thinner region to a rotatable head, the rotatable head being mounted to a pivotal rotary and bearing axle having a rotational axis parallel to a motor axis whereby a lateral deflection of the helical spring as a result of a yarn pull causes a rotational movement of the rotary and bearing axle.

12. Yarn-delivery device according to claim 11, further comprising a Hall element for generating a voltage signal, wherein the rotary and bearing axle includes a permanent magnet connected thereto, whereby the rotation of the rotary and bearing axle causes the permanent magnet to change the voltage signal for regulating a motor speed of the drive motor.

13. Yarn-delivery device according to claim 1, further comprising a yarn brake preceding said drive motor having a ball-bearing outer ring and having adjusting means for adjusting a bearing-friction resistance of the ball bearing, the yarn being guided over the ball-bearing outer ring.

14. Yarn-delivery device according to claim 13, wherein the adjusting means includes a permanent magnet provided between the ball bearings, the permanent magnet having north and south poles arranged parallel to the balls of each ball bearing.

15. Yarn-delivery device according to claim 13, wherein the adjusting means includes an electromagnetically actuatable coil.

16. Yarn-delivery device according to claim 1, further comprising a yarn-break sensor having a tilting lever for stopping a yarn drive in the event of a yarn break.

17. Yarn-delivery device according to claim 16, wherein the tilting lever is mounted on a rotatable shaft having a permanent magnet connected thereto, the permanent magnet actuating a reed relay when the tilting lever is deflected, the reed relay activating a luminous yarn-break indicator and switching off the textile machine.

18. Yarn-delivery device according to claim 1, further comprising a separating disc inserted at an intersection point of the steel wires, the separating disc having transverse holes for leading through the steel wires.

19. Yarn-delivery device according to claim 1, wherein a tending side of the yarn-delivery device points radially outwards in relation to an arrangement of a circular knitting machine.

* * * * *